US006988374B2

(12) United States Patent
Chang et al.

(10) Patent No.: US 6,988,374 B2
(45) Date of Patent: Jan. 24, 2006

(54) FROSTLESS HEAT EXCHANGER AND DEFROSTING METHOD THEREOF

(75) Inventors: Young-Soo Chang, Seoul (KR); Dae-Young Lee, Seoul (KR)

(73) Assignee: Korea Institute of Science and Technology, (KR)

( * ) Notice: Subject to any disclaimer, the term of this patent is extended or adjusted under 35 U.S.C. 154(b) by 0 days.

(21) Appl. No.: 10/950,768

(22) Filed: Sep. 27, 2004

(65) Prior Publication Data

US 2005/0066681 A1 Mar. 31, 2005

(30) Foreign Application Priority Data

Sep. 25, 2003 (KR) ..... 10-2003-0066646

(51) Int. Cl.
*F25D 21/10* (2006.01)

(52) U.S. Cl. ..... 62/82; 62/282; 165/133

(58) Field of Classification Search ..... 62/282, 62/82, 80, 272; 165/231, 232, 233, 133, 165/914; 106/13
See application file for complete search history.

(56) References Cited

U.S. PATENT DOCUMENTS 175,291 A * 3/1876 Lount ..... 62/282
2,672,024 A * 3/1954 McGrath ..... 62/282
2,686,407 A * 8/1954 Zellner ..... 62/82
2,776,166 A * 1/1957 Mendelson ..... 62/311
2,798,570 A * 7/1957 Kelley ..... 62/282
3,169,381 A * 2/1965 Persson ..... 62/282
3,300,993 A * 1/1967 Schlemmer ..... 62/63
3,307,618 A * 3/1967 Hagenauer et al. ..... 62/81
3,828,570 A * 8/1974 Stutz ..... 62/282
3,854,302 A * 12/1974 Masuda ..... 62/282
5,031,413 A * 7/1991 Tsuihiji et al. ..... 62/282

FOREIGN PATENT DOCUMENTS

KR 1999-005704 1/1999
KR 10-0335380 4/2002

* cited by examiner

*Primary Examiner*—Harry B. Tanner
(74) *Attorney, Agent, or Firm*—Ostrolenk, Faber, Gerb & Soffen, LLP

(57) ABSTRACT

A frostless heat exchanger used for an air-source system, comprises: an antifreezing solution supplying device for applying an antifreezing solution having a freezing point lower than a surface temperature of the heat exchanger on a surface of the heat exchanger to form a thin solution film on the surface of the heat exchanger in order to prevent formation of frost on the surface of the heat exchanger when the surface temperature of the heat exchanger drops below a freezing point of water (0° C.), so that the vapor is removed in such a manner that a highly concentrated antifreezing solution and the vapor are mixed together before the vapor becomes a supersaturated liquid and then grows to a frost crystal nucleus.

19 Claims, 2 Drawing Sheets

FIG. 2

| | |
|---|---|
| 20 | CONSTRUCT A HEAT EXCHANGER WITH A HYDROPHILIC POROUS SURFACE |
| 22 | OPERATE THE HEAT EXCHANGER |
| 24 | APPLY AN ANTIFREEZING SOLUTION TO THE HEAT EXCHANGER SURFACE |
| 26 | SEPARATE MOISTURE COLLECTED IN THE SOLUTION |
| 28 | SUPPLY THE MOISTURE TO A PREDEFINED SPACE |

FROSTLESS HEAT EXCHANGER AND DEFROSTING METHOD THEREOF

BACKGROUND OF THE INVENTION

1. Field of the Invention

The present invention relates to a frostless heat exchanger and a defrosting method thereof, more particularly, to a frostless heat exchanger and a defrosting method thereof used in an air-source refrigerating system such as an air-conditioner or the like, capable of preventing the efficiency of the heat exchanger from being degraded due to the creation of frost on a surface of the heat exchanger as moisture in the air condenses thereon when a surface temperature thereof drops below a freezing point of water.

2. Description of the Background Art

As refrigerating systems using a refrigerating cycle, such as a refrigerator, an air conditioner, is widely used in these days, demands for a high-efficiency refrigerating system are increasing. In general, the refrigerating system is divided into a liquid-source refrigerating system and an air-source refrigerating system. The liquid-source refrigerating system uses a liquid to cool or heat pipe(s) through which a refrigerant flows, while the air-source refrigerating system uses an air to cool or heat pipe(s) through which a refrigerant flows.

In the air-source refrigerating system, as frost formed on a surface of a heat exchanger, i.e. an evaporator, by condensation of the moisture around the heat exchanger, a degradation of the heat exchange efficiency thereof is brought about. More concretely, if a surface temperature of the evaporator drops below a freezing point of water (i.e. 0° C.), vapor around the evaporator loses its heat by the surface of the low temperature evaporator, and thus frost is formed on the surface of the evaporator, which is called "frosting". When the frosting is continued for some time, the frost grows to be a frost layer, and the frost layer functions as an insulation layer between the cold surface of the evaporator and the air including the ambient vapor, thereby degrading heat transfer efficiency. Due to the consecutive growth of the frost layer, an area of the air passage area is reduced, which causes an air pressure to drop.

Such a pressure drop affects operational characteristics of an air blower for blowing air around the evaporator, thereby reducing an air flow quantity around the evaporator. That is, heat transfer resistance between the surface thereof and the air therearound is increased by the frost formed on the surface of the evaporator, heat transfer performance of the evaporator is degraded because the air flow therearound is reduced, and consequently, the entire refrigerating system is fatally damaged. Accordingly, a defrosting process for melting and removing the frost layer formed on the surface thereof should be performed periodically.

As researches for removing a frost layer formed on a surface of the heat exchanger has been made, various methods for removing the frost layer have been developed. Among the various methods, a high temperature gas defrosting method, an electric defrosting method, a cycle reversing defrosting method are commonly used. Herein, the high temperature gas defrosting method is a method of removing a frost layer formed on a surface of a heat exchanger by using a high temperature gas of a discharge portion of a compressor. The electric defrosting method is a method of removing the frost layer by supplying heat with a heater to the surface of the heat exchanger on which the frost layer is formed. And the cycle reversing defrosting method is a method of converting a heating cycle between a freezing cycle and a heating cycle.

However, the high temperature gas defrosting method may not attain a reliable performance when the frost layer is thick. Moreover, the electric defrosting method has demerits of requiring a separate safety device for preventing the temperature around the heat exchanger from being increased excessively caused by a long defrosting operation, while the electric defrosting method has merits of easy control and operation. The cycle reversing method also has a problem that the degree of the amenity is decreased because the freezing or heating cycle rate is reduced.

A defrosting apparatus of a refrigerator devised by Jeon Yong-duk in Korean Patent Laid-Open No. 1999-005704 discloses a method for heating a heat exchanger by passing a high temperature anitifreezing solution, however, this method is disadvantageous in that it requires a safety device for preventing an excessive raise of temperature around the heat exchanger.

Furthermore, such defrosting process bring about various problems. Firstly, as a refrigerating system cannot be operated continuously during the defrosting operation, the temperature of an evaporator is raised and thus the refrigeration performance is reduced. Additionally, as an extra heat is supplied for the defrost process, additional energy is required to remove the extra heat when the refrigerating cycle is operated again.

Generally, it is difficult to predict a proper point of time requiring defrosting process because a growth speed of a frost layer formed at a surface thereof varies according to diverse variables, such as a position of the heat exchanger, a change of a heat transfer properties by a change of vapor in the ambient air, a temperature of the ambient air, a state of a surface of the exchanger, a temperature of a surface of the exchanger, and a flow speed of the ambient air. In addition, the melted water evaporates in the air around the low temperature heat exchanger (i.e., an evaporator) and freezes again on the surface of the heat exchanger, thereby causing an additional energy loss and degradation of freezing efficiency.

Recently, methods of delaying the frosting itself, instead of defrosting process after the frosting, are being proposed. For example, there is methods to use waste heat of a compressor, or to use a high temperature refrigerant of an outlet side of a compressor is used, or to increase the air temperature by heating a refrigerant. However, as these methods require an additional apparatus and additional energy for removing the frost, they still have problems that energy is consumed excessively and performance thereof is degraded.

Also, a frostless refrigerator using absorbent devised by Yoon Jum-yul in Korean Patent Laid-Open No. 2000-0074702 discloses a method of absorbing gaseous moisture in the air introduced into an evaporator by using a solid absorbent. However, the method has problems that an apparatus for absorbing and recycling an absorbent should be additionally required, that additional power is consumed to pass both introduced air and recycling air, and that an absorbing apparatus such as a heat pump may be larger than before so as to dehumidify a large amount of air.

SUMMARY OF THE INVENTION

Therefore, an object of the present invention is to provide a frostless heat exchanger, used for an air-source refrigerating system, capable of preventing degradation of performance of a heat exchanger and saving energy needed for defrosting by preventing formation of frost on a surface of the heat exchanger when the surface temperature of the exchanger drops below a freezing point of water (i.e., 0° C.), by removing a frost crystal nucleus causing growth of frost without an additional heating device.

Another object of the present invention is to provide a frostless heat exchanger capable of recycling the antifreezing solution applied to prevent generation of a frost layer on the surface of the heat exchanger so that the amount of antifreezing solution is less needed and an additional supply of the antifreezing solution is unnecessary.

Another object of the present invention is to provide a frostless heat exchanger having a function as a humidifier by spraying the moisture of the antifreezing solution obtained in a recycling process to a space in a refrigerating system required to humidify.

To achieve these and other advantages and in accordance with the purpose of the present invention, as embodied and broadly described herein, there is provided a frostless heat exchanger for an air-source system, comprising: an antifreezing solution supplying device for applying an antifreezing solution having a freezing point lower than a surface temperature of the heat exchanger on a surface of the heat exchanger to form a thin solution film on the surface of the heat exchanger in order to prevent formation of frost on the surface of the heat exchanger when the surface temperature of the heat exchanger drops below a freezing point of water, 0° C.

By such a structure, the vapor is removed in such a manner that a highly concentrated antifreezing solution and the vapor (or moisture) is mixed, before the vapor becomes a supersaturated liquid and then grows to a frost crystal nucleus. Consequently, a continuous or consecutive operation of the frostless heat exchanger can achieve improved efficiency of a heat exchange by preventing the formation of a frost layer. In addition, in the heat exchanger according to the present invention, a small amount of an antifreezing solution is supplied to a surface of the heat exchanger including a fin, a tube or the like, so that the antifreezing solution flows on the surface of the heat exchanger, forming a thin solution film on the surface of the heat exchanger, thereby preventing the generation of frost. That is, as the surface of the heat exchanger is coated in a form of a solution film of a highly concentrated antifreezing solution, drops of the antifreezing solution do not scatter and leak outside of the heat exchanger unlike the conventional method in which drops are dispersed because of spraying of the antifreezing solution. Accordingly, the heat exchanger according to the present invention does not require a mist eliminator for preventing a leakage of a liquid crystal of an antifreezing solution, and, simultaneously, can minimize heat transfer resistance between the surface of a heat exchanger and an air as well as flow resistance of an flowing air.

Here, preferably, the antifreezing solution has high concentration which is enough for the antifreezing solution to be mixed with a supersaturated liquid formed as vapor condenses on the surface of the heat exchanger and then to remove the supersaturated liquid from the surface of the heat exchanger by being detached from the surface of the heat exchanger.

In addition, a hydrophilic porous surface processing is performed on the surface of the heat exchanger so that the antifreezing solution can be easily spread on the surface.

Preferably, the antifreezing solution supplying device includes a plurality of antifreezing solution supplying openings installed at an upper portion of the heat exchanger and thus applies the antifreezing solution on the surface of the heat exchanger by dropping the solution, using gravity.

The antifreezing solution supplying device may apply the antifreezing solution on the surface of the heat exchanger by spraying using a spray nozzle.

Effectively, the frostless heat exchanger further comprises: an antifreezing solution collecting device for collecting the antifreezing solution detached from the surface of the heat exchanger in order to reuse the antifreezing solution applied to the surface of the heat exchanger; and an antifreezing solution recycling device for raising concentration of the antifreezing solution by removing moisture from the antifreezing solution collected by the antifreezing solution collecting device.

By such a construction, a consecutive operation can be made by reusing the antifreezing solution. Accordingly, refrigerating efficiency of a refrigerating system can be improved, and a long life span of the refrigerating system can be secured. Also, its use is facilitated by reducing the amount of used antifreezing solution and making additional supply of the antifreezing solution unnecessary.

In addition, preferably, the antifreezing solution recycling device separates the moisture from the antifreezing solution by heating the antifreezing solution and thus evaporating the moisture.

Here, the antifreezing solution recycling device may separate the moisture from the antifreezing solution by using a separation membrane, and the antifreezing solution recycling device may separate a highly concentrated antifreezing solution by freezing only water. Then heat exchanger is an evaporator used for a refrigerating system, and the antifreezing solution recycling device may separate the moisture from the antifreezing solution by supplying the antifreezing solution to a surface of the condenser of the refrigerating system and thus evaporating the moisture.

And, effectively, the moisture separated by the antifreezing solution recycling device is supplied to a space needed to humidify the refrigerating system.

Moreover, there is provided a defrosting method of a heat exchanger for an air-source refrigerating system comprising: a step of applying an antifreezing solution having a freezing point lower than a surface temperature of the heat exchanger on the surface of the heat exchanger so as to form a thin solution film on the surface of the heat exchanger in order to prevent formation of frost on the surface of the heat exchanger.

The foregoing and other objects, features, aspects and advantages of the present invention will become more apparent from the following detailed description of the present invention when taken in conjunction with the accompanying drawings.

BRIEF DESCRIPTION OF THE DRAWINGS

The accompanying drawings, which are included to provide a further understanding of the invention and are incorporated in and constitute a unit of this specification, illustrate embodiments of the invention and together with the description serve to explain the principles of the invention.

In the drawings:

FIG. 2 is flowchart of process steps carried out in accordance with the present invention.

DETAILED DESCRIPTION OF THE PREFERRED EMBODIMENTS

Figure 1:
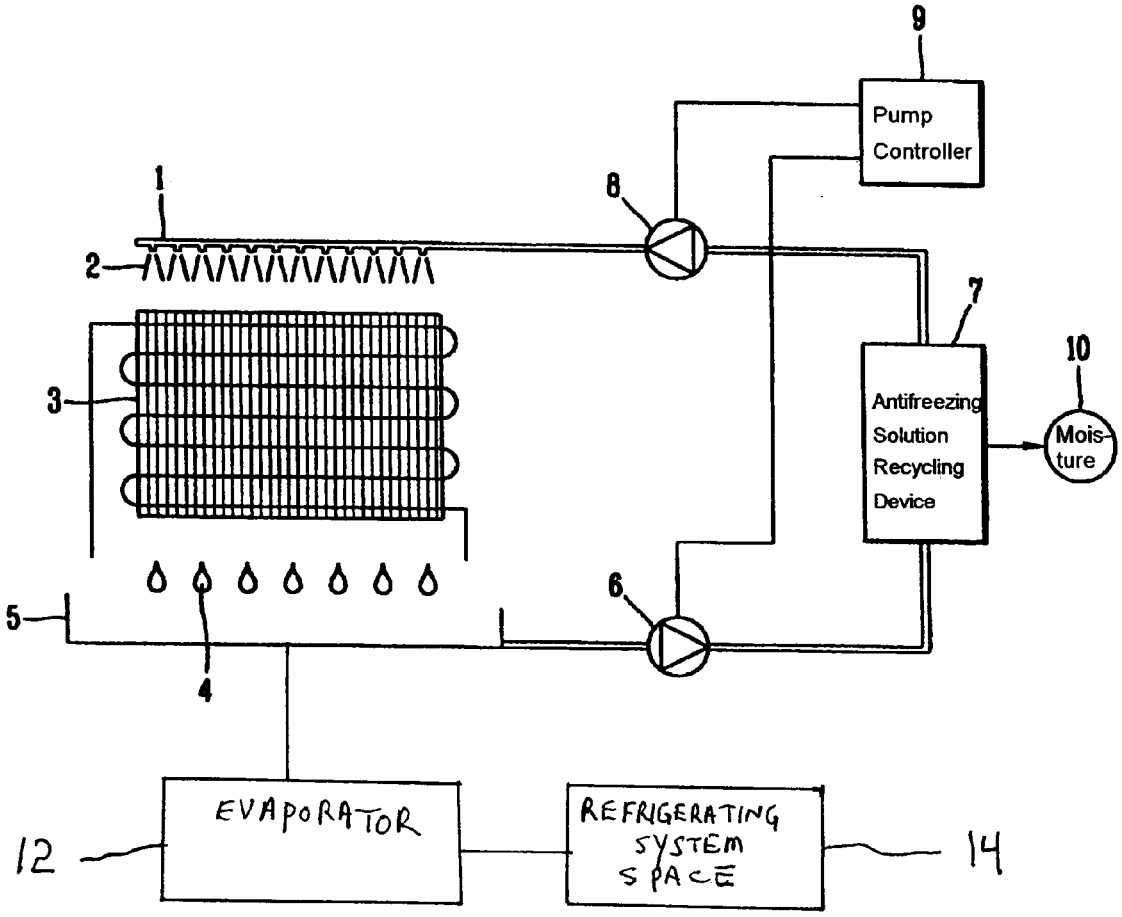
FIG. 1 is a schematic view showing a structure of a frostless heat exchanger according to one embodiment of the present invention.

Reference will now be made in detail to the preferred embodiments of the present invention, examples of which are illustrated in the accompanying drawings.

In describing the present invention, if a detailed explanation for a related know function or construction is considered to unnecessary divert the gist of the present invention, such explanation has been omitted but would be understood by those skilled in the art. In addition, the same reference numerals are given to the same parts described in the above-described structure, and the detailed descriptions thereon will be omitted.

FIG. 1 is a schematic view showing a construction of a frostless heat exchanger according to one embodiment of the present invention.

Generally, the growth of a frost layer on a surface of a low temperature heat exchanger such as an evaporator 3 is affected by surrounding conditions, such as a temperature of a cooling surface, a flow speed of the ambient air, a temperature and humidity of the ambient air or the like. A growing process of the frost layer is comprises three steps: a crystallizing period, a frost layer growing period and a frost layer maturing period. In detail, the frost layer growing process is a process in which phase transition of ambient vapor molecules are consecutively made from a gaseous state to a solid state, and essentially includes supersaturation process.

That is, when vapor in the air condenses, the condensing vapor passes the transition through a supersaturated liquid state and freezes, generating a frost crystal nucleus. Then, a frost layer begins to be generated centering around the frost crystal nucleus. Accordingly, if the supersaturated liquid is prevented from freezing into a frost crystal nucleus, the generation and growth of the frost on a surface of a heat exchanger such as an evaporator 3 can be prevented.

An antifreezing solution is a mixture of water and an inorganic liquid such as calcium chloride, sodium chloride or the like, or a mixture of water and an organic liquid such as ethylene glycol, propylene glycol or the like. While pure water has a freezing point of 0° C., as impurities are mixed with water at a higher rate, a freezing point of the antifreezing solution (i.e. mixture of water and impurities) drops lower than 0° C. Accordingly a highly concentrated antifreezing solution with a large amount of inorganic liquid or organic liquid has a lower freezing point in comparison with a lowly concentrated antifreezing solution with a small amount of said liquid. In addition, by its diffusion effect due to a concentration difference, the highly concentrated antifreezing solution is more easily mixed with the supersaturated liquid resulting from the condensation of vapor in the air as compared to the lowly concentrated antifreezing solution.

As shown in the drawing, a frostless heat exchanger according to one embodiment of the present invention prevents the generation of a frost layer from occurring by removing a frost crystal nucleus, which is an initial step of the generation of a frost layer on a surface of a low temperature heat exchanger, using the above-described principle. The frostless heat exchanger includes an evaporator 3, one of heat exchangers of a refrigerating system; an antifreezing solution supplying device 1 for applying a small amount of a highly concentrated antifreezing solution 2 on an entire surface of the evaporator to form a thin solution film; an antifreezing solution collecting device 5 for collecting a lowly concentrated antifreezing solution 4 falling down from the evaporator 3 after absorbing moisture condensing on a surface of the evaporator 3; a lowly concentrated antifreezing solution transferring pump 6 for transferring the lowly concentrated antifreezing solution from the antifreezing solution collecting device 5 to an antifreezing solution recycling device 7; an antifreezing solution recycling device 7 for converting the lowly concentrated antifreezing solution 4 into a highly concentrated antifreezing solution 2 by removing moisture from the lowly concentrated antifreezing solution 4; a highly concentrated antifreezing solution transferring pump 8 for transferring the highly concentrated antifreezing solution from the antifreezing solution recycling device 7 to the antifreezing solution supplying device 1; and a transferring pump controller 9 for controlling an operation of the pump 6 for transferring the lowly concentrated antifreezing solution and the pump 8 for transferring the highly concentrated antifreezing solution.

Preferably, a coating process is performed on the surface of the evaporator 3 so that, even if a small amount of the highly concentrated antifreezing solution 2 is applied on the surface of the evaporator 3 or an area where the solution 2 is applied is small, the highly concentrated antifreezing solution 2 can be widely spread on the surface of the evaporator 3. In such a coating process, the surface of the evaporator 3 is coated with a mixture of fine solid particles and a hydrophilic binder by a spray or a dipping method, and then a dipping process is performed thereon, so that the surface is coated with a layer having a hydrophilic porous structure providing the improved wettability. By such a surface processing, the highly concentrated antifreezing solution 2 can be spread on the entire surface of the evaporator and prevent local formation of a frost layer.

The antifreezing solution supplying device 1 is installed in order to prevent formation of frost on the surface of the evaporator 3 by applying the highly concentrated antifreezing solution 2 on the surface of the evaporator 3. However, the antifreezing solution itself may be another heat transfer resistance component on the surface of the evaporator 3. Therefore, preferably, the antifreezing solution is applied on the surface of the evaporator 3, forming an antifreezing solution film as thin as possible.

Here, in order to apply the highly concentrated antifreezing solution 2 on the surface of the evaporator 3 as thin as possible, the antifreezing solution supplying device 1 as a brine apparatus has a plurality of antifreezing solution supplying openings installed above the evaporator 3, and drops the antifreezing solution 2 by the gravity or the like to thereby evenly spray the solution 2 on the surface of the evaporator 3. As the antifreezing solution supplying device 1, a spray nozzle may spray the highly concentrated antifreezing solution 2 on the surface of the evaporator 3.

Effectively, the highly concentrated antifreezing solution 2 is in high concentration, which is enough for the solution 2 to be more easily mixed with a supersaturated liquid formed as vapor in the air condenses on the surface of the evaporator by its diffusion effect due to a condensation difference. Then, the mixed solution is in lowly concentration, and the lowly concentrated antifreezing solution 4 is detached from the surface of the heat exchange. In such a manner, the supersaturated liquid is removed from the surface of the heat exchanger. In addition, in order to perform such a function, the highly concentrated antifreezing solution 2 should have a freezing point lower than a temperature of a surface of the evaporator 3.

The antifreezing solution recycling device 7 is formed in order to recycle the lowly concentrated antifreezing solution 4 collected in the antifreezing solution collecting device 5, and generates a highly concentrated antifreezing solution 2 by separating moisture 10, which used to be the vapor, from the lowly concentrated antifreezing solution 4 by using a separation membrane (not shown). The antifreezing solution recycling device 7 may carry out such separation, using a separate heating device in a refrigerating system, which heats the lowly concentrated antifreezing solution 2 to thereby evaporate the moisture 10. Also, the antifreezing solution recycling device 7 may recycle the highly concentrated antifreezing solution 4, using a freezing point difference in such a manner in such a manner that the moisture 10 is separated from the lowly concentrated antifreezing solution 2 by freezing the lowly concentrated antifreezing solution 2 at a proper temperature.

If the evaporator 3 is used in the refrigerating system as a heat exchanger, an antifreezing solution recycling device 7 used for the evaporator 3 may separate the moisture 10 by supplying the antifreezing solution 4 to the surface of the condenser of the refrigerating system and thus evaporating the moisture 10.

The frostless heat exchanger according to one embodiment of the present invention constructed as above is operated as follows.

If the highly concentrated antifreezing solution 2 is applied from a plurality of an antifreezing solution supplying openings of the antifreezing solution supplying device 1 to the surface of the evaporator 3, the highly concentrated antifreezing solution 2 having a freezing point lower than a surface temperature of the evaporator 3 absorbs a supersaturated liquid formed as vapor around the evaporator 3 condenses on the surface of the evaporator 3, to thereby prevent the generation of a frost crystal nucleus and simultaneously become a lowly concentrated antifreezing solution 4. Then, the lowly concentrated antifreezing solution 4 is detached from the surface of the evaporator 3 and falls down to the antifreezing solution collecting device 5 by the gravity. The lowly concentrated antifreezing solution 4 collected in the antifreezing solution collecting device 5 is transferred to the antifreezing solution recycling device 7 by the lowly concentrated antifreezing solution transferring pump 6. Then, the antifreezing solution-recycling device 7 separates moisture 10 from the lowly concentrated antifreezing solution 4 to recycle the solution 4 into a highly concentrated antifreezing solution 2. Thereafter, the recycled highly concentrated antifreezing solution 2 is transferred to the antifreezing solution supplying device 1 by the highly concentrated antifreezing solution transferring pump 8 and is supplied to the surface of the evaporator 3, thereby making a consecutive operation possible.

Here, the moisture 10 separated from the antifreezing solution recycling device 7 performs humidification by being supplied to a freezing space dried due to freezing or a space where the humidification is needed.

As so far described, in the present invention, in order to prevent formation of frost on a surface of a heat exchanger when a surface temperature of a heat exchanger used for an air-source refrigerating system drops below a freezing point of water (0° C.),, the heat exchanger includes an antifreezing solution supplying device for applying a highly concentrated antifreezing solution having a freezing point lower than the surface temperature of the heat exchanger on the surface of the heat exchanger. Thus, the vapor is removed in such a manner that a highly concentrated antifreezing solution and the vapor are mixed together before the vapor becomes a supersaturated liquid and then grows to a frost crystal nucleus. Consequently, there is provided a frostless heat exchanger which is consecutively operated, has improved heat exchange efficiency by preventing the formation of a frost layer, and prevents deterioration of refrigerating system due to a decrease of an amount of pressure drop of the ambient air.

In addition, in the heat exchanger according to the present invention, a small amount of an antifreezing solution is supplied to a surface of the heat exchanger including a fin, a tube or the like, so that an antifreezing solution flows on the surface of the heat exchanger, forming a thin solution film on the surface of the heat exchanger, thereby preventing the generation of frost. That is, as the surface of the heat exchanger is coated with a solution film of an antifreezing solution, for example by dropping, drops of the antifreezing solution do not scatter and leak outside unlike the conventional method in which drops are dispersed because of spraying of the antifreezing solution. Accordingly, the heat exchanger according to the present invention does not require a mist eliminator for preventing a leakage of a liquid crystal of the antifreezing solution, and, simultaneously, can minimize flow resistance of the antifreezing solution and resistance of heat transfer.

Because the present invention does not heat surface(s) of the heat exchanger in order to remove a frost layer around the heat exchanger, energy can be saved and performance of the heat exchanger can be improved.

In addition, in the present invention, because an antifreezing solution used to prevent formation of a frost layer on the surface of the heat exchanger is recycled, a continuous or consecutive operation can be made. Accordingly, freezing efficiency of a refrigerating system is increased, a long life span of the refrigerating system can be secured. Also, the heat exchanger can be conveniently used because the amount of used antifreezing solution is reduced and a supply of an additional antifreezing solution is unnecessary.

Further, in the present invention, as the moisture having separated in a process of recycling the antifreezing solution is applied to a space in the refrigerating system required to be humidified, a frostless heat exchanger functioning as a humidifier is provided.

As described above, and as shown in FIG. 1, an evaporator 12 is coupled with the heat exchanger 3 and supplies moisture to a predefined refrigerating system space 14 which requires to be humidified.

With reference to FIG. 2, the foregoing description of the invention teaches the step 20 involving constructing a heat exchanger with a hydrophilic porous surface; the step 22 comprising operating the heat exchanger; the step 24 comprising applying an antifreezing solution to the surface of the heat exchanger; the step 26 comprising separating moisture collected in the antifreezing solution; and the step 28 comprising supplying the moisture to a predefined space associated with the refrigerating system. The moisture separator element may utilize a heater or a separation member or the like.

As the present invention may be embodied in several forms without departing from the spirit or essential characteristics thereof, it should also be understood that the above-described embodiments are not limited by any of the details of the foregoing description, unless otherwise specified, but rather should be construed broadly within its spirit and scope as defined in the appended claims, and therefore all changes and modifications that fall within the metes and bounds of the claims, or equivalence of such metes and bounds are therefore intended to be embraced by the appended claims.

What is claimed is:

1. A frostless heat exchanger for an air-source system which comprises:

an antifreezing solution supplying device for applying an antifreezing solution having a freezing point lower than a surface temperature of the heat exchanger on a surface of the heat exchanger to form a thin solution film on the surface of the heat exchanger in order to prevent formation of frost on the surface of the heat exchanger, and a mixture of fine, solid particles and a hydrophilic binder being coated on the surface of the heat exchanger so as to form a hydrophilic porous surface thereon.

2. The frostless heat exchanger of claim 1, wherein the antifreezing solution is highly concentrated.

3. The frostless heat exchanger of claim 1, wherein the antifreezing solution supplying device includes a plurality of antifreezing solution supplying openings installed at an upper portion of the heat exchanger and thus applies the antifreezing solution on the surface of the heat exchanger by dropping the solution.

4. The frostless heat exchanger of claim 1, wherein the antifreezing solution supplying device applies the antifreezing solution on the surface of the heat exchanger by spraying using a spray nozzle.

5. The frostless heat exchanger of claim 2, further comprising:

an antifreezing solution collecting device for collecting the antifreezing solution detached from the surface of the heat exchanger in order to reuse the antifreezing solution applied to the surface of the heat exchanger; and an antifreezing solution recycling device so as to increase the concentration of the antifreezing solution by removing moisture from the antifreezing solution collected by the antifreezing solution collecting device.

6. The frostless heat exchanger of claim 5, wherein the heat exchanger is an evaporator used for a refrigerating system.

7. The frostless heat exchanger of claim 5, wherein the heat exchanger is an evaporator used for a refrigerating system, and the moisture separated from the antifreezing solution is supplied to a space in the refrigerating system required to be humidified.

8. A method of defrosting a surface of a heat exchanger for an air-source system which comprises:

a step of applying an antifreezing solution having a freezing point lower than a surface temperature of the heat exchanger on the surface of the heat exchanger so as to form a thin solution film on the surface of the heat exchanger in order to prevent formation of frost on the surface of the heat exchanger, and performing a hydrophilic porous surface processing on the surface of the heat exchanger so that the antifreezing solution can easily spread on the surface.

9. A method of claim 8, wherein the antifreezing solution is highly concentrated.

10. A method of claim 8, wherein the step of applying an antifreezing solution is performed before frost is formed on the surface of the heat exchanger.

11. A method of claim 8, wherein the step of applying an antifreezing solution is performed continuously.

12. A method of claim 8, wherein the antifreezing solution is supplied to the surface of the heat exchanger from the upper portion of the heat exchanger by dropping.

13. A method of claim 8, wherein the antifreezing solution is supplied to the surface of the heat exchanger by spraying.

14. A method of claim 8, further comprising:

a collecting step of collecting an lowly concentrated antifreezing solution detached from the surface of the heat exchanger wherein the lowly concentrated antifreezing solution is mixed with moisture;

a recycling step of transforming the lowly concentrated antifreezing solution into a highly concentrated antifreezing solution;

a reusing step of applying the recycled highly concentrated antifreezing solution on the surface of the heat exchanger.

15. A method of claim 14, wherein the recycling step comprises separating the moisture from the lowly concentrated antifreezing solution by heating the lowly concentrated antifreezing solution and evaporating the moisture in the lowly concentrated antifreezing solution.

16. A method of claim 14, wherein the recycling step comprises separating the moisture from the lowly concentrated antifreezing solution by using a separation membrane.

17. A method of claim 14, wherein the recycling step comprises separating the moisture from the lowly concentrated antifreezing solution freezing only water in the lowly concentrated antifreezing solution.

18. A method of claim 14, further comprising:

a step of applying the moisture filtered in the recycling step to a space in the refrigerating system required to be humidified.

19. A method of claim 14, wherein the heat exchanger is an evaporator used for a refrigerating system, and in the recycling step, the lowly concentrated antifreezing solution is applied on the surface of a condenser of the refrigerating system so as to evaporate moisture in the lowly concentrated antifreezing solution.

* * * * *